US005358072A

United States Patent [19]

Szatkowski et al.

[11] Patent Number: 5,358,072

[45] Date of Patent: Oct. 25, 1994

[54] WHEEL FLANGE LUBRICATION WITH ENCLOSED STRAND DRIVE

[75] Inventors: James G. Szatkowski, Elmhurst; Alexander C. Crosman, III, Downers Grove; Jay S. Boggess, Justice, all of Ill.

[73] Assignee: General Motors Corporation, Detroit, Mich.

[21] Appl. No.: 27,121

[22] Filed: Mar. 5, 1993

[51] Int. Cl.[5] ..... B61K 3/00

[52] U.S. Cl. ..... 184/3.2; 184/6.4; 184/99; 184/108; 242/564.4; 226/53

[58] Field of Search ..... 184/3.2, 6.4, 27.1, 184/99; 242/55.53; 226/53; 104/279

[56] References Cited

U.S. PATENT DOCUMENTS

| | | | |
|---|---|---|---|
| 990,637 | 4/1911 | Dawson . | |
| 1,088,928 | 3/1914 | Reid . | |
| 1,156,037 | 10/1915 | Quigley | 226/53 |
| 1,177,632 | 4/1916 | Johnson . | |
| 1,222,341 | 4/1917 | Wholey . | |
| 1,756,726 | 4/1930 | Brost . | |
| 1,912,490 | 6/1933 | Miller . | |
| 2,160,784 | 5/1939 | Milbank . | |
| 2,580,687 | 1/1952 | McMillan . | |
| 2,637,411 | 5/1953 | Harbison . | |
| 2,866,521 | 12/1958 | Gibson . | |
| 2,935,159 | 5/1960 | Burrell . | |
| 4,765,250 | 8/1988 | Goding . | |
| 4,811,818 | 3/1989 | Jamison . | |
| 4,915,856 | 4/1990 | Jamison . | |
| 4,940,002 | 7/1990 | Bien . | |
| 5,054,582 | 10/1991 | Aracil . | |
| 5,085,292 | 2/1992 | Dial . | |
| 5,251,724 | 10/1993 | Szatkowski et al. . | |

FOREIGN PATENT DOCUMENTS 110896 11/1917 United Kingdom .

OTHER PUBLICATIONS

Electro-Motive's Wheel Flange Lubrication System Brochure, LB17-890, 1990 General Motors Corporation.

Brochure-Glidemaster, Wheel Flange Lubrication System for Heavy-Haul Locomotives, The Solid Alternative, Durafilm Corporation (4 pages).

Flier-Glidemaster, Wheel Flange Lubrication System for Heavy Haul Locomotives Durafilm Corporation (1 page).

Photo-SD45 Operator's Manual-4th Edition Feb., 1968, Service Department, Electro-Motive Division (2 pages).

*Primary Examiner*—Thomas E. Denion

*Attorney, Agent, or Firm*—C. K. Veenstra

[57] ABSTRACT

A railway vehicle wheel flange lubrication system includes a body mounted integrated supply/drive unit, a gapless delivery hose of low friction, e.g. thermoplastic, material and a truck mounted holder bracket. The supply/drive unit has a box enclosing a lubrication strand dispensing reel, a gearmotor drive unit, a control panel with operating circuitry and a lube out signal. The gearmotor drive uses a preferably nylon housing with an enclosed, preferably arcuate, passage in which a toothed sprocket driven by a stalled gearmotor penetrates and drives a lubricant strand. The bracket is configured for sturdy mounting on an axle bearing adapter to maintain the hose end against the associated wheel flange.

16 Claims, 5 Drawing Sheets

WHEEL FLANGE LUBRICATION WITH ENCLOSED STRAND DRIVE

TECHNICAL FIELD

This invention relates to railway rail lubrication carried out by wheel flange lubricating systems for railway vehicles such as locomotives and in particular to solid strand lubricant feeding systems with improved features including drive and delivery means.

BACKGROUND

It is known in the art relating to rail lubrication to apply lubricant to the flanges of selected wheels of a rail vehicle such as a locomotive in order to transfer the lubricant to the edges of the associated rails and thereby reduce friction and wear between the rail and the flanges of not only the lubricated wheels but also of other wheels subsequently traversing the track. Various types of lubricant have been utilized including liquids, greases and so-called solid block and strand lubricants.

A prior solid strand lubricant feeding system utilized a solid but somewhat ductile strand of plastic supported lubricant formed in a roll and fed through a tube supported by a locomotive frame and a wheel guided follower to lubricate the wheel flange. Dual gripping rollers driven by a stalled gearmotor drive were used to force the lubricant strand through the tube.

SUMMARY OF THE INVENTION

The present invention provides an improved solid strand lubricant feeding system having a compactly packaged delivery unit, a wheel related delivery bracket and interconnecting conducting hose. The delivery unit package includes a box enclosing a strand feed reel, a gearmotor with enclosed penetrating tooth strand drive, a lubricant replacement signal and an electrical control panel.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
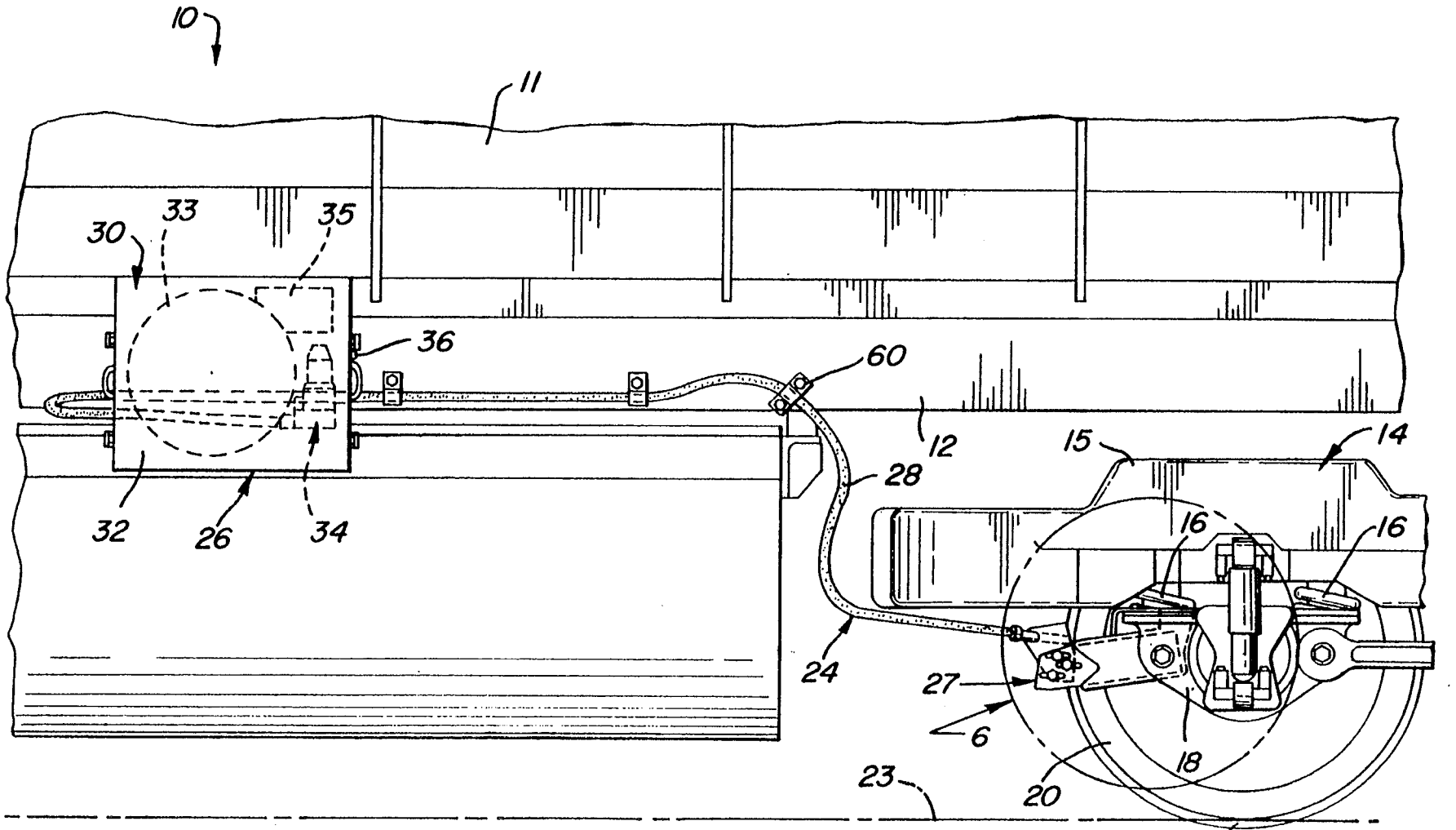
FIG. 1 is a side view of a portion of the underframe and a supporting truck of a railway dieselelectric locomotive showing the application of an exemplary embodiment of wheel flange lubricating system according to the invention.

Referring now to the drawings in detail, numeral 10 generally indicates pertinent portions of a diesel-electric railway locomotive having a carbody 11 including a supporting underframe 12 which is carried upon a pair of trucks 14 of which only one is shown. The trucks may be, for example, be of the radial self steering type described in U.S. Pat. No. 4,765,250 issued Aug. 23, 1988, although the invention could be used with other types of trucks if desired. Each truck 14 has a frame 15 which is pivotably or turnably connected with the underframe 12 through a cushioning suspension, not shown. Each frame is in turn carried upon a yieldable primary suspension, such as springs 16 carried by bearing adapters 18 or journal boxes supported by bearings, one on each end of one or more axles, not shown, each axle being drivingly connected to a pair of wheels 20. Each of the wheels 20 includes a flange 22 for guidingly engaging the edge of an associated one of a pair of rails 23 along which the wheels roll when the locomotive is in motion.

The locomotive includes a rail (or flange) lubrication system generally indicated by numeral 24 which applies lubricant to at least one of the wheel flanges 22 from which it is deposited on the contacted rail edge for lubricating contact with later passing wheels of the same or following trains. The lubrication system 24 comprises in general a lubricant supply/drive unit 26, a holder bracket 27 and a delivery hose 28 connecting the two.

Figure 2:
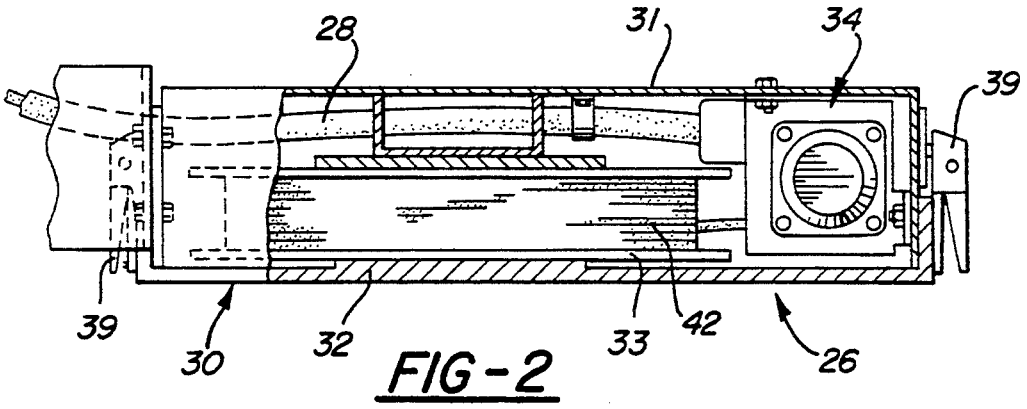
FIGS. 2 and 3 are top and side views of a lubricant supply/drive unit as in FIG. 1 partially broken away to show internal elements.
Figure 3:
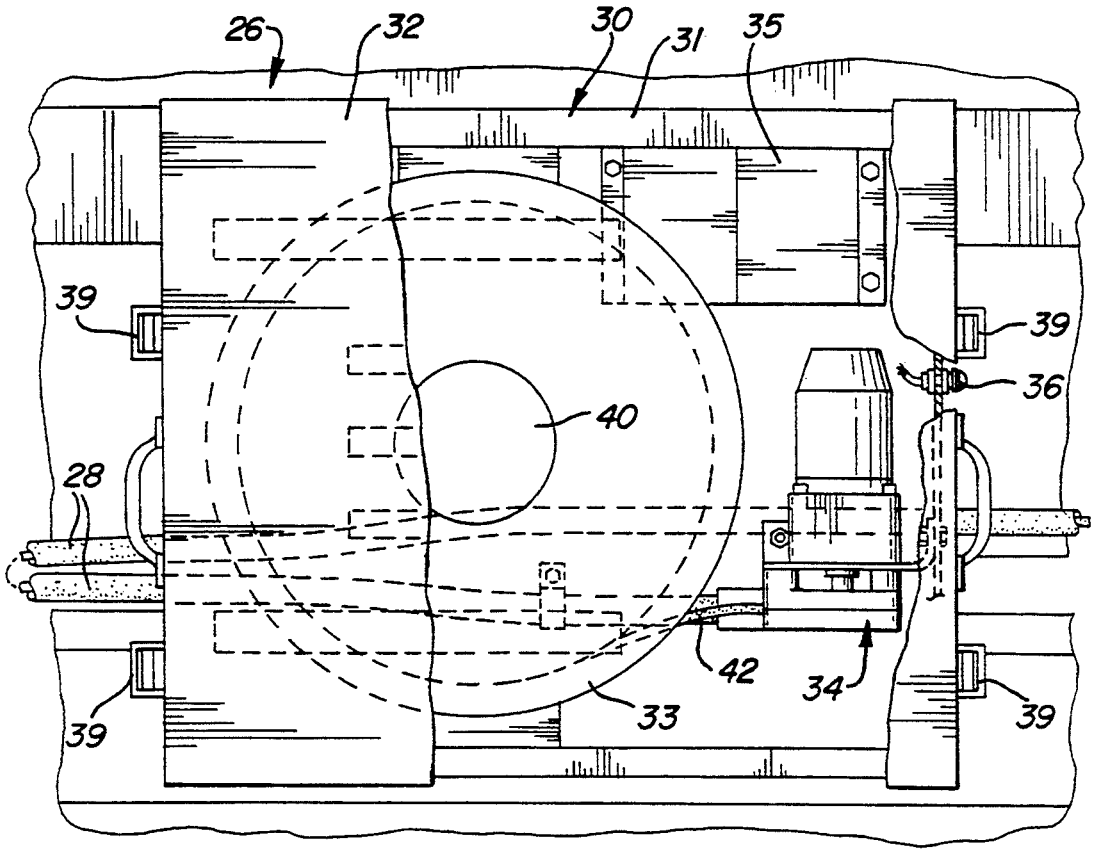

The unit 26, best shown in FIGS. 2 and 3, is encased in a box 30 preferably mounted on the side of the locomotive underframe 12 where it is easily accessible for servicing. The box 30 includes a five sided container 31 having an open side facing the outside of the locomotive for easy access and closed by a removable cover 32. Within the container are mounted a lubricant reel 33, gearmotor drive 34 and control panel 35. A "lube out" indicator light 36, comprising a lubricant replacement signal, is mounted on one side of the box. The cover 32 hangs on a lip at the upper edge 38 of the container and is held closed by four latches 39 to provide a close fit resistant to the intrusion of fluids and contaminants.

The reel 33 is rotatable about a generally horizontal axis on a fixed hub 40 and is replaceable by sliding off the hub when the cover is open. The closed cover retains in place the reel which holds a coiled strand 42 of consumable plastic based solid but ductile lubricant. A preferred type is available coiled on a replacement reel from E/M Corporation of Everett, Washington as Glidemaster TM formulation WX0093 and is reportedly covered by U.S. Pat. No. 4,915,856 issued Apr. 10, 1990. The strand has a surface oil coating which assists in reducing drive force requirements for propelling the strand through the drive 34 and delivery hose 28.

Figure 4:
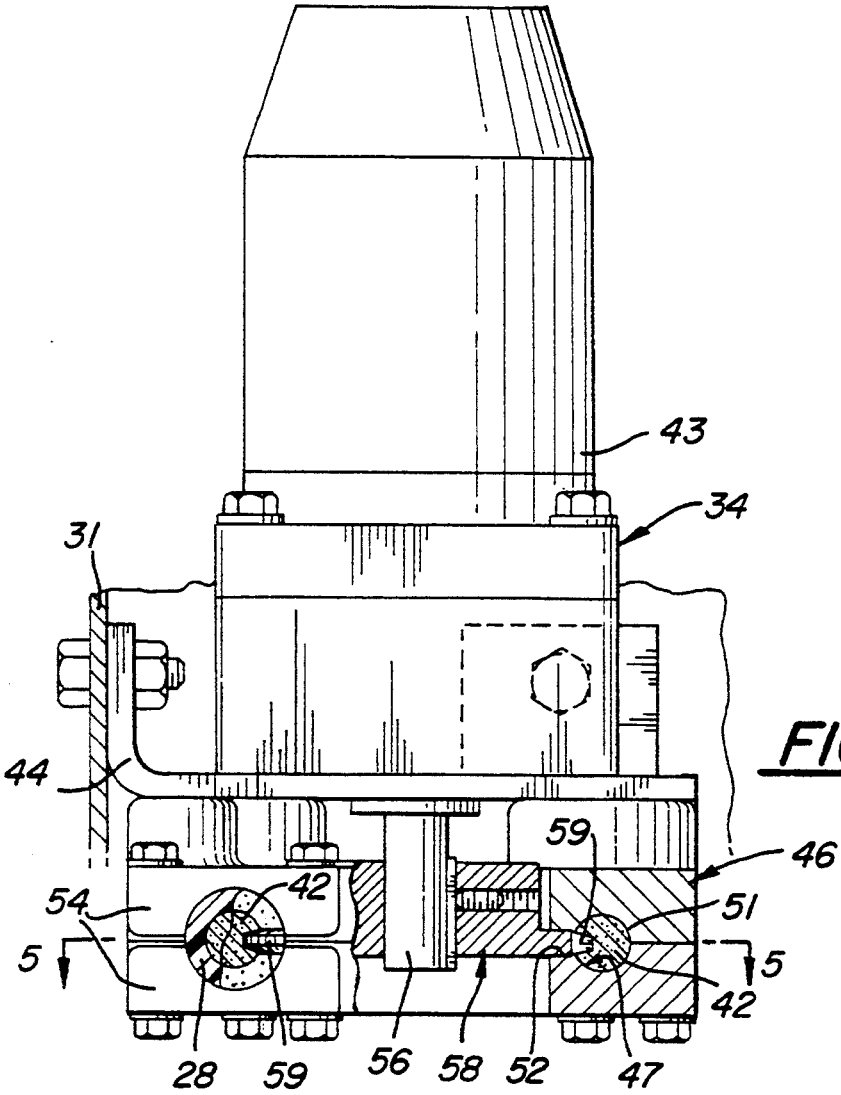
FIG. 4 is an end view of the gearmotor drive from the feed and delivery end and partially broken away to show the drive sprocket application.
Figure 5:
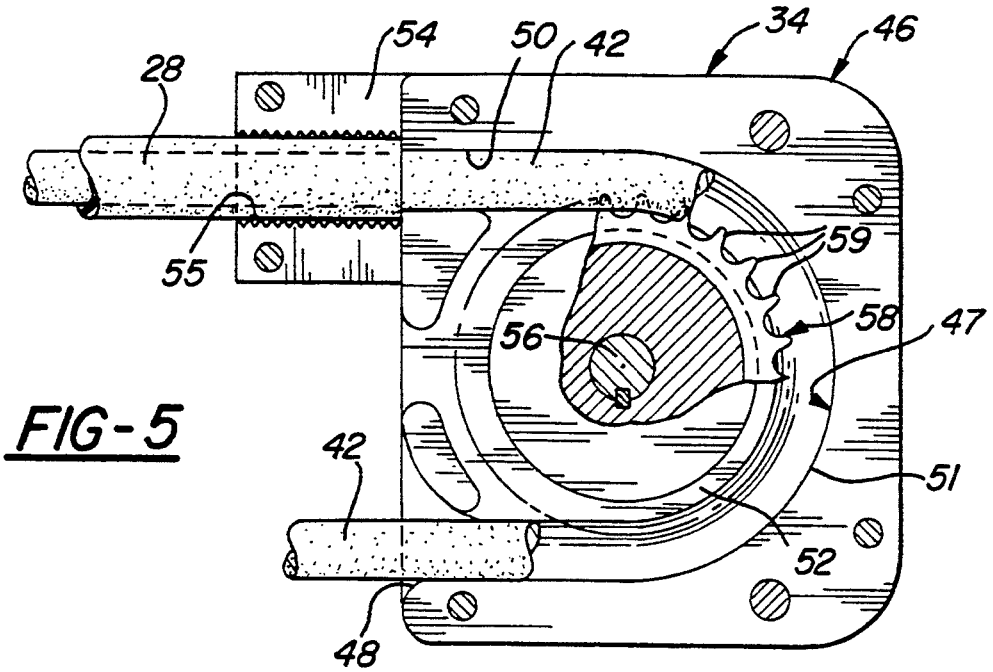
FIG. 5 is a cross-sectional view of the drive interior from the line 5—5 of FIG. 4.

The gearmotor drive 34 as seen in FIGS. 4 and 5 includes a combined motor and reduction gear unit or gearmotor 43 fixed to a mounting bracket 44 and a two piece drive housing 46. The drive housing has upper and lower members which are made of a suitable low friction material of adequate strength and toughness, such as high strength nylon alloys. Material MF2014 from Miller Felpax Corporation of Winona, Minn. is an example. Internally, as seen in FIG. 5, the housing defines a passage 47 of circular cross section slightly larger than the diameter of the lubricant strand 42. The passage has a radiused inlet 48 and a straight outlet 50 connected by a semicircular arcuate portion 51. A slot 52 is provided on the inner side of the passage which is otherwise completely enclosed. At the outlet 50, extensions 54 of the housing members have grooved or otherwise toughened cylinder surfaces 55, the extensions being spaced apart slightly to allow clamping of an inserted hose.

The gearmotor 43 has a rotatable output shaft 56 on which is fixed a toothed sprocket 58 such as a roller chain sprocket having relatively sharp spaced teeth 59. The shaft carries the sprocket for rotation within the drive housing 46 with the teeth extending through the slot 52 into the passage 47, particularly in the arcuate portion 51 and adjacent parts of the inlet 48 and outlet 50.

Figure 8:
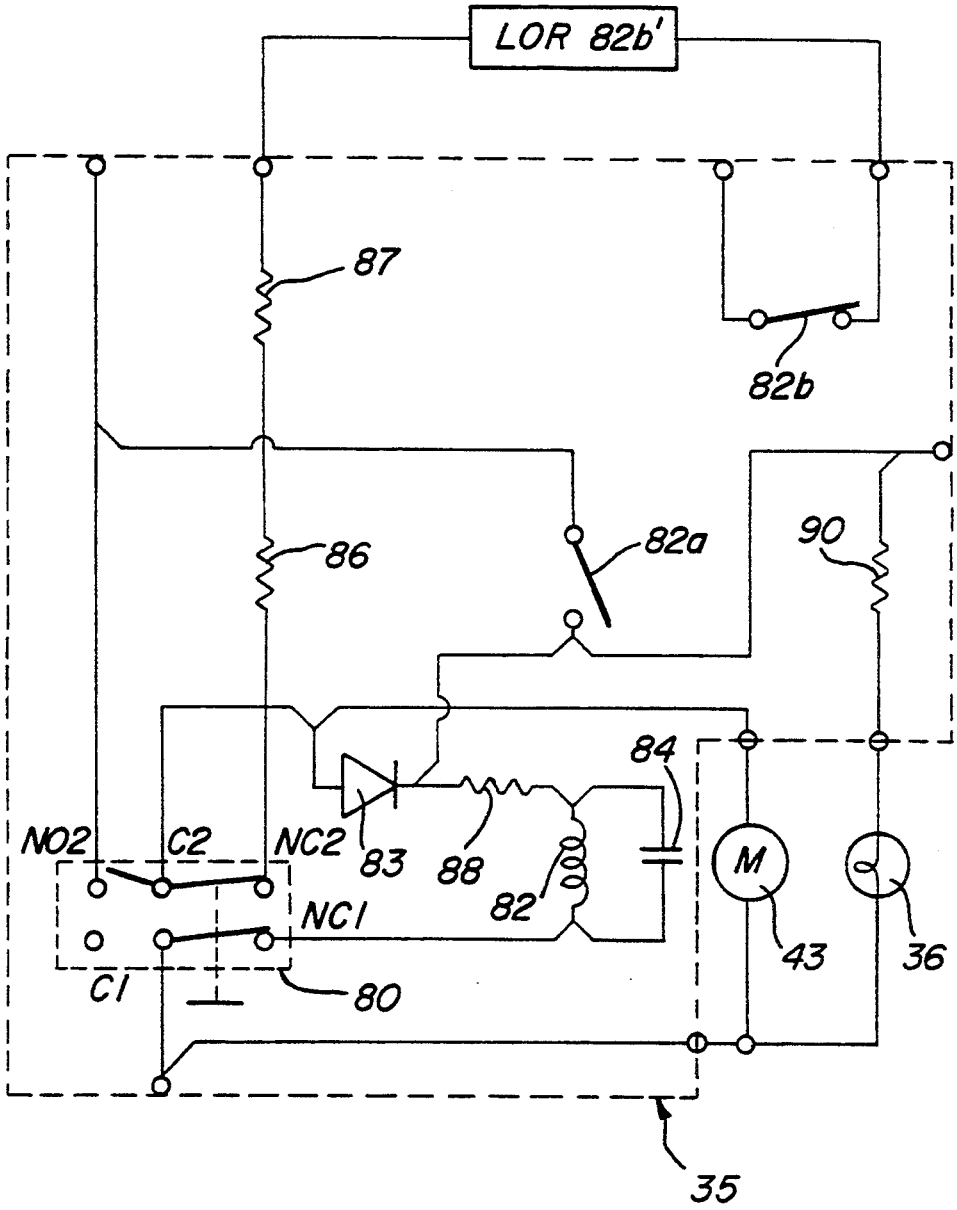
FIG. 8 is a schematic of the electrical circuit for the gearmotor and lubricant replacement signal.

The control panel 35 mounts electrical components for connection in a circuit as shown in FIG. 8 and to be subsequently described.

The delivery hose 28 may be formed of any suitable material having a low friction inner surface and capable of being mounted in the manner to be described and of conducting the lubricant from the drive 34 to the wheel flange 22 under extremes of ambient temperature. At present, Hytron TM thermoplastic hose from Imperial Eastman TM of Chicago, Ill., having a urethane interior tube of diameter equal to that of the drive housing passage 47, is preferred but any suitable alternative may be used. The hose is preferably made in one continuous piece so that an unbroken inner surface in presented for passage of the lubricant strand. If more than one piece is used, the adjoining ends must be butted without leaving any gap or the ductile material may extrude into the gap and impede or stop movement of the strand.

The hose 28 has one end inserted into the surfaces 55 of the drive housing extensions and butted against the end of the passage outlet 50 so that no gap remains between the outlet 50 and the hose interior. The extensions 54 are clamped on the hose to assure its retention in the installed position. The hose 28 then extends out of the box 30 and is led toward the holder bracket 27 with smooth curvature and straight Portions clamped at suitable points to the locomotive underframe 12. An unsupported portion extends to the holder bracket 27 from a clamp 60 on an adjacent portion of the underframe, leaving sufficient free length to allow for movement of the associated truck 14. The hose is held by the bracket 27 with its outlet end in contact with the associated wheel flange 22.

Figure 6:
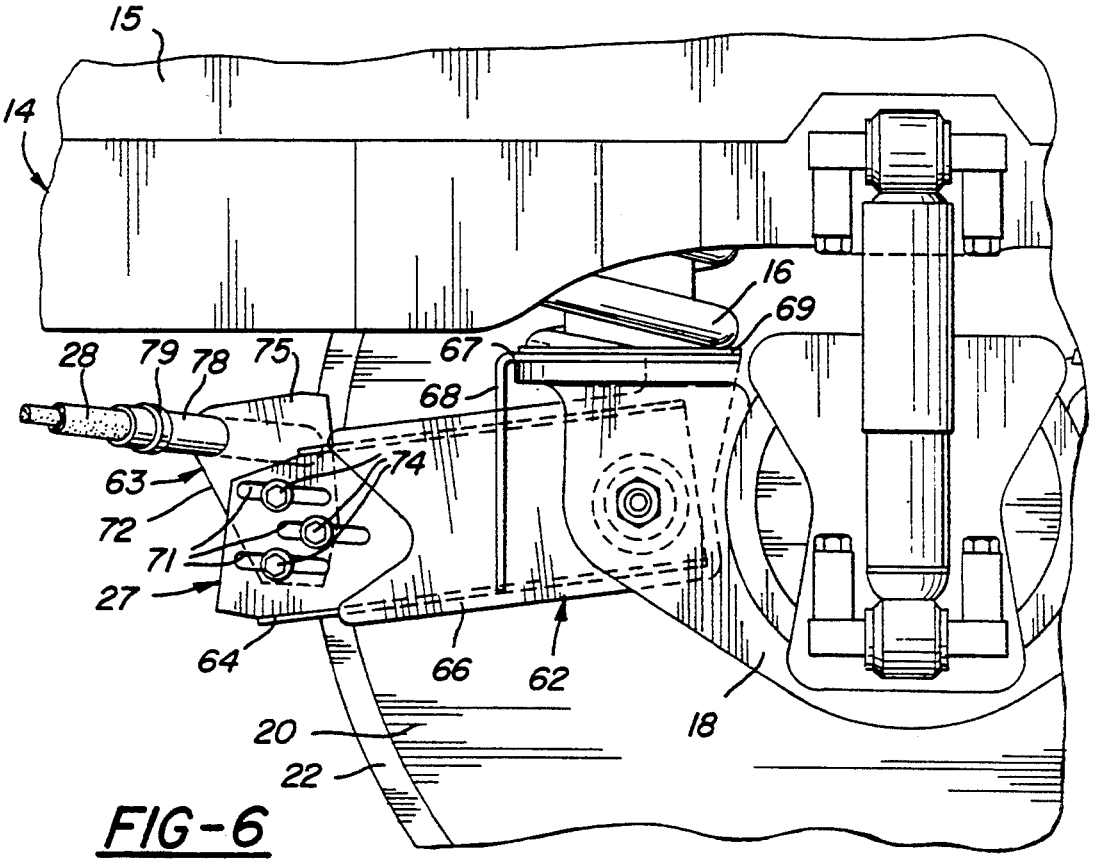
FIG. 6 is an enlarged view of the truck mounted holder bracket portion of the system shown in circle 6 of FIG. 1.
Figure 7:
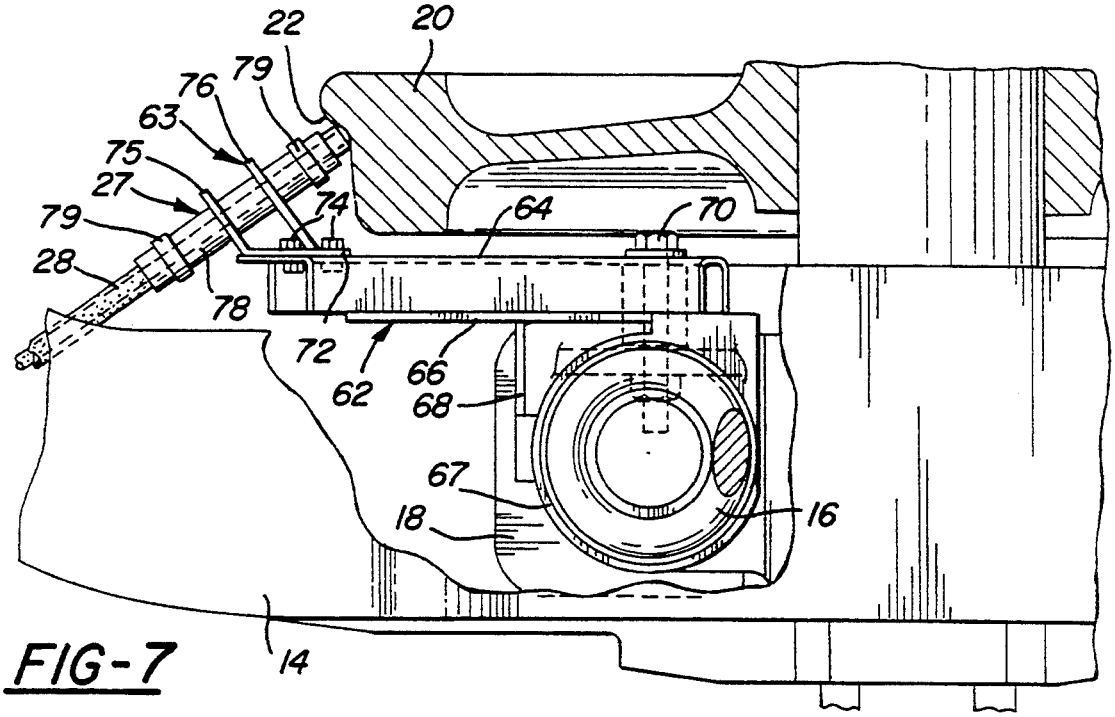
FIG. 7 is a top view of the portion illustrated in FIG. 6.

The holder bracket 27, best shown in FIGS. 6 and 7, includes a support member 62 and a guide member 63. Support member 62 comprises a wide U-channel section 64 welded at one end and along the open outer side to a side plate 66 to form a sturdy rectangular box section. A top plate 67 extends horizontally from the side plate and a stiffener 68 connects the side and top plates. The top plate supports and is sandwiched below a pilot plate 69 which acts as a spring seat for one of the springs 16 of the associated railway truck and the box section one end is bolted below the spring seat to a flange of the bearing adapter 18. A bolt 70 passes through openings in the channel 64 and side plate 66 with suitable spacers being provided to allow sturdy clamping and to properly position the support member 62. The box section extends generally longitudinally with a slight downward slope to adjacent the wheel periphery where part of the side plate is cut away to provide access to three horizontal slots 71 in the web of channel 64 which is the outer side of the box section.

The guide member 63 has a flat portion 72 secured by bolts 74 to the three slots 71 of the box section channel 64. The outer end 75 of the portion 72 is bent inward at about 35° and combines with a parallel plate 76 welded to the flat portion 72 to support a tube 78. The tube angles slightly downward and inward at about 55° from longitudinal to a point spaced close to the wheel flange 22 and adjustable by loosening and sliding the bolts 74 in the slots 71. The delivery hose 28 has its end distal from the supply/drive unit 26 received in the tube and abutting the wheel flange 22. A pair of clamps 79 are mounted near the ends of the tube, which are preferably slotted to allow resilient movement upon tightening the clamps to positively secure the hose. Although not required with the tapered roller axle bearings illustrated, the tube could be pivotally or flexibly mounted or provided with a flexible nozzle for applications using straight roller axle bearings where some lateral motion of the wheel relative to the bearing adapter is allowed.

FIG. 8 is a schematic of the electrical circuit for the control panel 35, gearmotor 43 and light 36 of the unit 26. The equipment includes a control switch 80, lube out relay (LOR) 82 with normally open and normally closed contacts **82*a*, 82*b* and related elements including diode 83, capacitor 84 and resistors 86, 87, 88, 90**.

Contact NC2 of the switch 80 is connected through resistors 86, 87 and external circuits with the LOR contact **82*b*. The external circuit also includes in series a similar LOR contact 82*b*′** from a companion control panel for another flange lubrication system on the other side of the locomotive.

In operation of the illustrated embodiment of rail lube system, a reel 33 of strand lubricant 42 is loaded onto the hub 40 of the container 31. The free end of the strand 42 is inserted into the inlet 48 of the drive housing 46 and pushed into the passage 47 until it engages the teeth 59 of the sprocket 58. The switch 80 may then be actuated to disconnect the illustrated closed contacts C2-NC2 and C1-NC1 and connect power from terminal NO2 to C2. This feeds full auxiliary system voltage to the gearmotor 43.

The motor turns the drive sprocket causing the teeth to penetrate the strand, pulling it into the passage 47 and pushing it through the outlet 50 and the delivery hose until it reaches the other end and contacts the wheel flange 22. The switch 80 is then returned to the illustrated position so that when power is applied for driving the locomotive, reduced voltage is provided across the gearmotor 43 and the LOR 82. The load then stalls the motor which has stall torque sufficient to advance the strand through the hose as the lubricant is used by application through rubbing contact to first the wheel flange and then the associated rail.

The complete enclosure of the lubricant strand 42 in the passage 47 and the delivery hose 28 is an important feature of the system. If spaces or substantial clearances are permitted in the drive unit or the portion of the system following the drive which is under constant load, the strand 42 may be deformed by the force and fill in the spaces or clearances. The strand may then jam, halting its advance through the hose 28. The low friction surfaces of the drive passage 47 and the interior of the hose 28 assist in maintaining the motion as do the teeth of the sprocket which are shaped with a relatively sharp configuration to penetrate the strand to drivingly grip the material without causing too much deformation of the strand 42 in the passage 47.

In the stalled condition, the voltage across the motor remains too low to actuate the LOR coil 82, connected in parallel with the motor. However, when the following end of a strand has been pushed through the drive passage 47, the motor load is released and the motor turns freely. The voltage then increases significantly, such as from about 10–15 volts to about 50–60 volts based on a 74 volt DC electrical system common in locomotives. The higher voltage is sufficient to actuate the LOR, closing contact 82*a* to complete a lock-in circuit through the relay coil 82 and provide power to the lube out light 36, indicating to the observer that a new reel of lubricant should be installed. Concurrently, power to the motor is cut off by opening of the LOR contact 82*b* so the motor will not continue operating until an additional reel mounted coiled strand of lubricant is installed. This also occurs if lubricant runs Out on the other side of the locomotive so that lubricant is cut off from both sides if either unit runs out. The LOR holding circuit may also be connected with the locomotive computer to give a service indication or record as desired. Upon opening the control switch 80, the LOR circuit is opened and the system is reset for motor drive operation when a new lubricant reel has been installed and fed into the drive housing 46.

While the invention has been described primarily by reference to a preferred embodiment, it should be understood that numerous changes could be made within the spirit and scope of the inventive concepts described. For example, the shape of the lubricant strand could be altered from a round cross section, the elements in the supply/drive unit 26 could be arranged differently or in separate housings or locations, the drive housing could be arranged for more or less wrap-around curvature of the passage 47 or for a straight through drive and more than one sprocket drive could be utilized at the beginning of the feed or at some further location along the way. The type and mounting of the holder bracket could be altered to best accommodate the locomotive or truck arrangement on which it is applied. Alternative materials for the hose and other components might be used.

Also, other suitable electrical circuits and control schemes may be applied as desired. Some contemplated alternatives include:

Addition of a time delay relay to allow charging, clearing or momentary slippage of the lubricant feed without fault detection;

Solid state devices could replace the mechanical relays, e.g. a silicon-controlled-rectifier could provide the latching action and a Zener diode could provide the voltage detection;

Voltage transducers could be used to measure motor voltage and signal excess voltage conditions.

Accordingly it is intended that the invention not be limited to the disclosed embodiments, but that it have the full scope permitted by the language of the following claims.

What is claimed is:

1. A wheel flange lubrication system for a railway vehicle having a body, a truck having a frame supporting and movable relative to the body and a rail engaging wheel having a flange and carrying bearing means supporting the truck frame on a movable suspension, said system comprising, a supply unit including a box containing a hub for rotatably receiving a reel having a coiled strand of lubricant and drive means for driving the lubricant strand through the system, a delivery hose connected to the drive means to receive the strand of lubricant and forming at least a part of a continuous path leading to the wheel flange, and a bracket mounted on the truck and supporting means defining the path adjacent the wheel flange, wherein the drive means includes a DC gearmotor drivably mounting a toothed sprocket and means defining an enclosed path for conducting the lubricant strand and into which teeth of the sprocket penetrate for engaging and advancing the strand through the system.

2. A wheel flange lubrication system as in claim 1 wherein the path defines an arc encompassing a substantial number of the sprocket teeth.

3. A wheel flange lubrication system for a railway vehicle having a body, a truck having a frame supporting and movable relative to the body and a rail engaging wheel having a flange and carrying bearing means supporting the truck frame on a movable suspension, said system comprising, a supply unit including a box containing a hub for rotatably receiving a reel having a coiled strand of lubricant and drive means for driving the lubricant strand through the system, a delivery hose connected to the drive means to receive the strand of lubricant and forming at least a part of a continuous path leading to the wheel flange, and a bracket mounted on the truck and supporting means defining the path adjacent the wheel flange, wherein the drive means includes a DC motor operative in stalled condition to force a lubricant strand through the passage, and the system further includes lube out indicating means operative o actuate a signal in response to a change in the motor condition from stalled to free running operation.

4. A wheel flange lubrication system for a railway vehicle having a body, a truck having a frame supporting and movable relative to the body and a rail engaging wheel having a flange and carrying bearing means supporting the truck frame on a movable suspension, said system comprising, a supply unit including a box containing a hub for rotatably receiving a reel having a coiled strand of lubricant and drive means for driving the lubricant strand through the system, a delivery hose connected to the drive means to receive the strand of lubricant and forming at least a part of a continuous path leading to the wheel flange, and a bracket mounted on the truck and supporting means defining the path adjacent the wheel flange, wherein the bracket includes a fixed part fastened to the bearing means and having a portion inserted between the bearing means and yieldable means forming part of the suspension, and an adjustable part mounted for radial adjustment near an outer end of the fixed part and directly supporting the path defining means in an adjustable fixed position adjacent the wheel flange.

5. A wheel flange lubrication system for a railway vehicle having a body, a truck having a frame supporting and movable relative to the body and a rail engaging wheel having a flange and carrying bearing means supporting the truck frame on a movable suspension, said system comprising, a supply unit including a box containing a hub for rotatably receiving a reel having a coiled strand of lubricant and drive means for driving the lubricant strand through the system, a delivery hose connected to the drive means to receive the strand of lubricant and forming at least a part of a continuous path leading to the wheel flange, and a bracket mounted on the truck and supporting means defining the path adjacent the wheel flange, wherein the delivery hose is the sole means forming the path from the drive means to the wheel flange, and wherein the hose has an interior tube formed of a material having a low surface friction substantially equivalent to that of urethane.

6. A wheel flange lubrication system for a railway vehicle having a body, a truck having a frame supporting and movable relative to the body and a rail engaging wheel having a flange and carrying bearing means supporting the truck frame on a movable suspension, said system comprising, a supply unit including a box containing a hub for rotatably receiving a reel having a coiled strand of lubricant and drive means for driving the lubricant strand through the system, and a delivery hose connected to the drive means to receive the strand of lubricant and forming at least a part of a continuous path leading to the wheel flange, wherein the drive means includes a DC gearmotor drivably mounting a toothed sprocket and means defining an enclosed arcuate path for conducting the lubricant strand and into which a substantial number of teeth of the sprocket penetrate for engaging and advancing the strand through the system, the gearmotor being operative in an essentially stalled condition to advance the strand in response to operational delivery of the lubricant to the wheel flange, the delivery hose is the sole means defining the path for delivering strand lubricant from the drive means to the flange, the supply unit further includes a control panel mounting electrical equipment for operating the drive means, and a lube out indicator including a signal light mounted on the exterior of the box and connected with the control panel equipment, the indicator being responsive to a voltage change across the gearmotor from the stalled to a free running condition to arcuate the indicator and light the signal light, and the bracket is connected with the bearing means to move directly with the heel and support the path defining means in a predetermined position adjacent the wheel flange, and the bracket includes a fixed part fastened to the bearing means and having a portion inserted between the bearing means and yieldable means forming part of the suspension, and an adjustable part mounted for radial adjustment near an outer end of the fixed part and directly supporting the hose in an adjustable fixed position adjacent the wheel flange.

7. A supply unit for solid lubricant delivery and comprising a box including a container and a removable cover closing the container for protecting the contents therein, a hub in the container for rotatably supporting a reel of coiled strand lubricant, the cover when closed retaining the reel on the hub, and drive means in the container for receiving and advancing the lubricant strand into a connected conduit.

8. A supply unit for solid lubricant delivery and comprising, a box including a container and a removable cover closing the container for protecting the contents therein, a hub in the container for rotatably supporting a reel of coiled strand lubricant, the cover when closed retaining the reel on the hub, and drive means in the container for receiving and advancing the lubricant strand into a connected conduit, and further comprising a control panel in the container and carrying electrical control means for operating the drive means, the control means being responsive to a free running condition of the drive means to cut off operation thereof.

9. A supply unit as in claim 8 and further comprising a signal light mounted on the container, the control means being connected to the light and operative to indicate an absence of lubricant supply by actuating on the signal light upon such free running condition of the motor.

10. A supply unit as in claim 9 wherein the control means is operative to sense a change in the voltage across the drive means from an essentially stalled condition to the free running condition to actuate the signal light and cut off the drive means.

11. Drive means for moving a solid strand lubricant through a passage, the drive means comprising, a housing having an enclosed passage therethrough and a smooth interior surface, a slot extending axially along part of at least one side of the passage, and toothed means extending through the slot into the passage and movable in the slot for penetrating and advancing strand lubricant through the passage, wherein the housing has the passage defining portion formed of a material having low surface friction characteristics equivalent to or better than nylon.

12. A holder bracket for use with a flange lubrication system of a rail vehicle having wheel carried bearing means supporting a yieldable suspension for the vehicle, the bracket comprising a support member having a rigid beam having means near one end for fastening to the bearing means and plate means rigidly fixed adjacent the one end for clamping horizontally between the bearing means and the suspension to rigidly fix the support member with the beam extending generally radially with an opposite end near the wheel periphery, and a guide member having a base portion secured to the opposite end of the beam and a riser portion solidly connecting the base with a tubular holder for receiving lubricant dispensing means, the holder extending at an angle inward from the direction of the beam to a point closely spaced from the rail engaging surface of the wheel flange when the bracket is installed on a vehicle.

13. A holder bracket as in claim 12 wherein the guide member is fastened to the beam by slotted means allowing radial adjustment of the guide member on the beam for accurately locating the holder relative to the wheel flange.

14. A holder bracket as in claim 13 wherein the tubular holder is slotted at at least one end and clamp means are provided for clamping said one end of the holder on said dispensing means.

15. A holder bracket as in claim 14 wherein the beam is a rectangular box section.

16. A wheel flange lubrication system for a railway vehicle having a body, a truck having a frame supporting and movable relative to the body and a rail engaging wheel having a flange and carrying bearing means supporting the truck frame on a movable suspension, said system having a supply unit for solid lubricant delivery and comprising a box including a container and a removable cover closing the container for protecting the contents therein, a hub in the container for rotatably supporting a reel of coiled strand lubricant, the cover when closed retaining the reel on the hub, and drive means in the container for receiving and advancing the lubricant strand into a delivery hose, the drive means comprising a housing having an enclosed passage therethrough and a smooth interior surface, a slot extending axially along part of at lest one side of the passage, toothed means extending through the slot into the passage and movable in the slot for penetrating and advancing the strand lubricant through the passage, the delivery hose forming at least a part of a continuous path leading to the wheel flange, and a bracket mounted on the truck and comprising a support member having a rigid beam having means near one end for fastening to the bearing means, and plate means rigidly fixed adjacent the one end for clamping horizontally between the bearing means and the suspension to rigidly fix the support member with the beam extending generally radially with an opposite end near the wheel periphery, and a guide member having a base portion secured to the opposite end of the beam and a riser portion solidly connecting the base with a tubular holder for receiving the delivery hose, the holder extending at an angle inward from the direction of the beam to a point closely spaced from the rail engaging surface of the wheel flange when the bracket is installed on a vehicle.

* * * * *